US005221904A

United States Patent [19]

Shimasaki et al.

[11] Patent Number: 5,221,904

[45] Date of Patent: Jun. 22, 1993

[54] MISFIRE-DETECTING SYSTEM FOR INTERNAL COMBUSTION ENGINES

[75] Inventors: Yuuichi Shimasaki; Masataka Chikamatsu; Takuji Ishioka; Shigetaka Kuroda; Hideaki Arai, all of Wako, Japan

[73] Assignee: Honda Giken Kogyo Kabushiki Kaisha, Tokyo, Japan

[21] Appl. No.: 846,636

[22] Filed: Mar. 5, 1992

[30] Foreign Application Priority Data

| | | | |
|---|---|---|---|
| Mar. 7, 1991 | [JP] | Japan | 3-072558 |
| Mar. 7, 1991 | [JP] | Japan | 3-072559 |
| Mar. 7, 1991 | [JP] | Japan | 3-072560 |
| Mar. 7, 1991 | [JP] | Japan | 3-072561 |

[51] Int. Cl.[5] ..... F02P 17/00; F02M 51/00

[52] U.S. Cl. ..... 324/378; 123/479; 324/388

[58] Field of Search ..... 324/378, 388, 399, 391; 123/644, 479, 630; 73/116, 117.3; 361/253

[56] References Cited

U.S. PATENT DOCUMENTS

| | | | |
|---|---|---|---|
| 3,961,240 | 6/1976 | Pohl | 324/399 |
| 4,825,167 | 4/1989 | Bayba | 324/399 |
| 4,886,029 | 12/1959 | Lill et al. | 324/380 |
| 4,918,389 | 4/1990 | Schleupen et al. | 324/399 |
| 5,019,779 | 5/1991 | Ookawa | 324/388 |
| 5,046,470 | 9/1991 | Entenmann et al. | 324/399 |
| 5,174,261 | 12/1992 | Fuji et al. | 123/479 |

*Primary Examiner*—Kenneth A. Wieder
*Assistant Examiner*—Maura K. Regan
*Attorney, Agent, or Firm*—Nikaido, Marmelstein, Murray & Oram

[57] ABSTRACT

A misfire-detecting system detects a misfire occurring in an internal combustion engine in such a manner that a value of discharge current is detected when sparking voltage is generated in response to an ignition command signal, the detected value of discharge current is compared with a predetermined current value, and it is determined that a misfire has occurred when a time period over which the detected discharge current value after generation of the ignition command signal is above the predetermined current value is shorter than a predetermined time period.

6 Claims, 10 Drawing Sheets

FUEL INJECTION VALVE
6
2
3
3'
θTH
4
PBA
7
8
TA
9
TW
10
CYL
12
NE
11
INTERNAL COMBUSTION ENGINE
1
16
13
LAF
15
THREE-WAY CATALYST
14
INPUT CIRCUIT
5a
CPU
5b
MEMORY MEANS
5c
OUTPUT CIRCUIT
5d
MISFIRE-DETECTING CIRCUIT
5e
ECU
5

MISFIRE-DETECTING SYSTEM FOR INTERNAL COMBUSTION ENGINES

BACKGROUND OF THE INVENTION

1. Field of the Invention

This invention relates to a misfire-detecting system for internal combustion engines, and more particularly to a misfire-detecting system which is capable of detecting a misfire attributable to the fuel supply system.

2. Prior Art

In an internal combustion engine in general, high voltage (sparking voltage) generated by the ignition coil of the engine is sequentially distributed to the spark plugs of the cylinders of the engine via a distributor, to ignite a mixture supplied to the combustion chambers. If normal ignition does not take place at one or more of the spark plugs, i.e. a misfire occurs, it will result in various inconveniences such as degraded driveability and increased fuel consumption. Furthermore, it can also result in so-called after-burning of unburnt fuel gas in the exhaust system of the engine, causing an increase in the temperature of a catalyst of an exhaust gas-purifying device arranged in the exhaust system. Therefore, it is essential to prevent occurrence of a misfire. Misfires are largely classified into ones attributable to the fuel supply system and ones attributable to the ignition system. Misfires attributable to the fuel supply system are caused by the supply of a lean mixture or a rich mixture to the engine, while misfires attributable to the ignition system are caused by failure to spark (so-called misfiring), i.e. normal spark discharge does not take place at the spark plug, due to smoking or wetting of the spark plug with fuel, particularly adhesion of carbon in the fuel to the spark plug, which causes current leakage between the electrodes of the spark plug, or an abnormality in the ignition circuit.

A conventional misfire-detecting system is already known from Japanese Patent Publication (Kokoku) No. 51-22568, which utilized the fact that the frequency of damping oscillation voltage generated in a primary circuit of an ignition device whenever the contacts of the distributor are opened is higher when a spark ignition occurs than when failure to spark occurs.

However, the conventional misfire-detecting system is only based upon the frequency of damping oscillation voltage generated in the ignition circuit, i.e. based upon whether or not a discharge occurs between the electrodes of the spark plug. Therefore, the conventional system is unable to discriminate whether a misfire detected is attributable to a cause in the fuel supply system such that although a discharge has actually occurred, the mixture is not fired due to its lean or rich state, or to a cause in the ignition system, thus failing to take a satisfactory and prompt fail-safe action.

SUMMARY OF THE INVENTION

It is the object of the invention to provide a misfire-detecting system for internal combustion engines, which is capable of accurately detecting a misfire attributable to the fuel supply system.

To attain the above object, according to a first aspect of the invention, there is provided a misfire-detecting system for detecting a misfire occurring in an internal combustion engine having an ignition system including at least one spark plug, engine operating condition-detecting device for detecting values of operating parameters of the engine, signal-generating device for determining ignition timing of the engine, based upon the detected values of the operating parameters of the engine and generating an ignition command signal indicative of the determined ignition timing, and igniting device responsive to the ignition command signal for generating sparking voltage for discharging the at least one spark plug.

The misfire-detecting system according to the invention is characterized by comprising:

current value-detecting device for detecting a value of discharge current when the sparking voltage is generated by the igniting device in response to generation of the ignition command signal; and misfire-determining device for comparing the detected value of the discharge current with a predetermined current value, and determining whether or not a misfire has occurred in the engine, based upon results of the comparison;

the misfire-determining device determining that a misfire has occurred when a time period over which the detected value of the discharge current is above the predetermined current value in response to generation of the ignition command signal is shorter than a predetermined time period.

According to a second aspect of the invention, the misfire-detecting system comprises:

current value-detecting device for detecting a value of discharge current when the sparking voltage is generated by the igniting device in response to generation of the ignition command signal; and misfire-determining device for comparing the detected value of the discharge current with a predetermined current value, and determining whether or not a misfire has occurred in the engine, based upon results of the comparison;

the misfire-determining device determining that a misfire has occurred when a time period over which the detected value of the discharge current is above the predetermined current value after the lapse of a first predetermined time period from the time of generation of the ignition command signal is shorter than a second predetermined time period.

According to a third aspect of the invention, the misfire-detecting system comprises:

current value-detecting device for detecting a value of discharge current when the sparking voltage is generated by the igniting device in response to generation of the ignition command signal; and misfire-determining device for comparing the detected value of the discharge current with a predetermined current value, and determining whether or not a misfire has occurred in the engine, based upon results of the comparison;

the misfire-determining device determining a value proportional to an area of a portion of detected values of the discharge value below the predetermined current value before a predetermined time period elapses after generation of the ignition command signal, and determining that a misfire has occurred, when the determined value proportional to the area is equal to or larger than a predetermined area value.

According to a fourth aspect of the invention, the misfire-detecting system comprises:

current value-detecting device for detecting a value of discharge current when the sparking voltage is generated by the igniting device in response to generation of the ignition command signal; and misfire-determining device for comparing the detected value of the discharge current with a predetermined current value, and determining whether or not a misfire has occurred in the engine, based upon results of the comparison;

the misfire-determining device determining a value proportional to an area of a portion of detected values of the discharge value below the predetermined current value before a predetermined time period elapses after generation of the ignition command signal, and determining that a misfire has occurred, when the determined value proportional to the area is smaller than a predetermined area value.

The above and other objects, features, and advantages of the invention will become more apparent from the following detailed description taken in conjunction with the accompanying drawings.

DETAILED DESCRIPTION

The invention will now be described in detail with reference to the drawings showing embodiments thereof.

Figure 1:
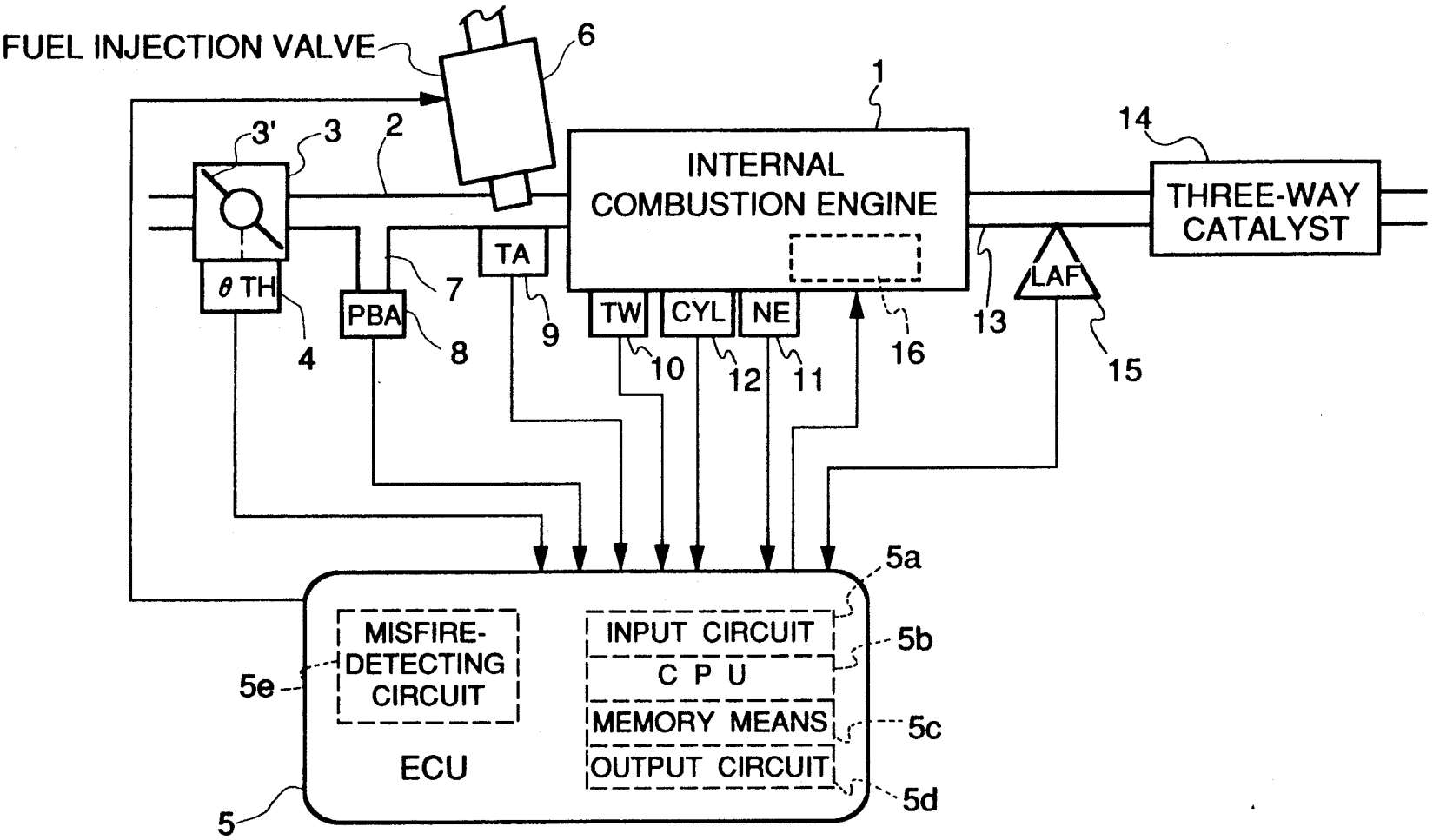
FIG. 1 is a block diagram showing the whole arrangement of an internal combustion engine incorporating a misfire-detecting system according to the invention.

Referring first to FIG. 1, there is shown the whole arrangement of an internal combustion engine incorporating a misfire-detecting system according to the invention. In an intake pipe 2 of an engine 1, there is arranged a throttle body 3 accommodating a throttle valve 3' therein. A throttle valve opening ($\theta$TH) sensor 4 is connected to the throttle valve 3' for generating an electric signal indicative of the sensed throttle valve opening and supplying the same to an electronic control unit (hereinafter referred to as "the ECU") 5.

Fuel injection valves 6 are each provided for each cylinder and arranged in the intake pipe at a location between the engine 1 and the throttle valve 3' and slightly upstream of an intake valve, not shown. The fuel injection valves 6 are connected to a fuel pump, not shown, and electrically connected to the ECU 5 to have their valve opening periods controlled by signals therefrom.

On the other hand, an intake pipe absolute pressure (PBA) sensor 8 is provided in communication with the interior of the intake pipe 2 via a conduit 7 at a location immediately downstream of the throttle valvw 3' for supplying an electric signal indicative of the sensed absolute pressure to the ECU 5. An intake air temperature (TA) sensor 9 is inserted into the intake pipe 2 at a location downstream of the intake pipe absolute pressure sensor 8 for supplying an electric signal indicative of the sensed intake air temperature TA to the ECU 5.

An engine coolant temperature (TW) sensor 10, which may be formed of a thermistor or the like, is mounted in the cylinder block of the engine 1 for supplying an electric signal indicative of the sensed engine coolant temperature TW to the ECU 5. An engine rotational speed (NE) sensor 11 and a cylinder-discriminating (CYL) sensor 12 are arranged in facing relation to a camshaft or a crankshaft of the engine 1, neither of which is shown. The engine rotational speed sensor 11 generates a pulse as a TDC signal pulse at each of predetermined crank angles whenever the crankshaft rotates through 180 degrees, while the cylinder-discriminating sensor 12 generates a pulse at a predetermined crank angle of a particular cylinder of the engine, both of the pulses being supplied to the ECU 5.

A three-way catalyst 14 is arranged within an exhaust pipe 13 connected to the cylinder block of the engine 1 for purifying noxious components such as HC, CO and $NO_X$. An $O_2$ sensor 15 as an exhaust gas ingredient concentration sensor (referred to hereinafter as an "LAF sensor") is mounted in the exhaust pipe 13 at a location upstream of the three-way catalyst 14, for supplying an electric signal having a level approximately proportional to the oxygen concentration in the exhaust gases to the ICU 5.

Further, an ignition device 16, which comprises an ignition coil, and spark plugs, hereinafter referred to, is provided in the engine 1 and controlled to effect spark ignition by an ignition command signal A from the ECU 5.

The ECU 5 comprises an input circuit **5*a* having the functions of shaping the waveforms of input signals from various sensors as mentioned above, shifting the voltage levels of sensor output signals to a predetermined level, converting analog signals from analog-output sensors to digital signals, and so forth, a central processing unit (hereinafter referred to as "the CPU") 5*b*, memory means 5*c* storing various operational programs which are executed by the CPU 5*b* and for storing results of calculations therefrom, etc., an output circuit 5*d* which outputs driving signals and the ignition command signal A to the fuel injection valves 6 and the ignition device 16, respectively, and a misfire-detecting circuit 5*e***, hereinafter described.

The CPU **5*b* operates in response to the above-mentioned signals from the sensors to determine operating conditions in which the engine 1 is operating such as an air-fuel ratio feedback control region and open-loop control regions, and calculates, based upon the determined engine operating conditions, the valve opening period or fuel injection period $T_{OUT}$ over which the fuel injection valves 6 are to be opened in synchronism with inputting of TDC signal pulses to the ECU 5**.

Further, the CPU 5b calculates the ignition timing TIG of the engine, based upon the determined engine operating condition.

The CPU 5b performs calculations as described hereinbefore, and supplies the fuel injection valves 6 and the ignition device 16, respectively, with driving signals and the ignition command signal A based on the calculation results through the output circuit 5d.

Figure 2:
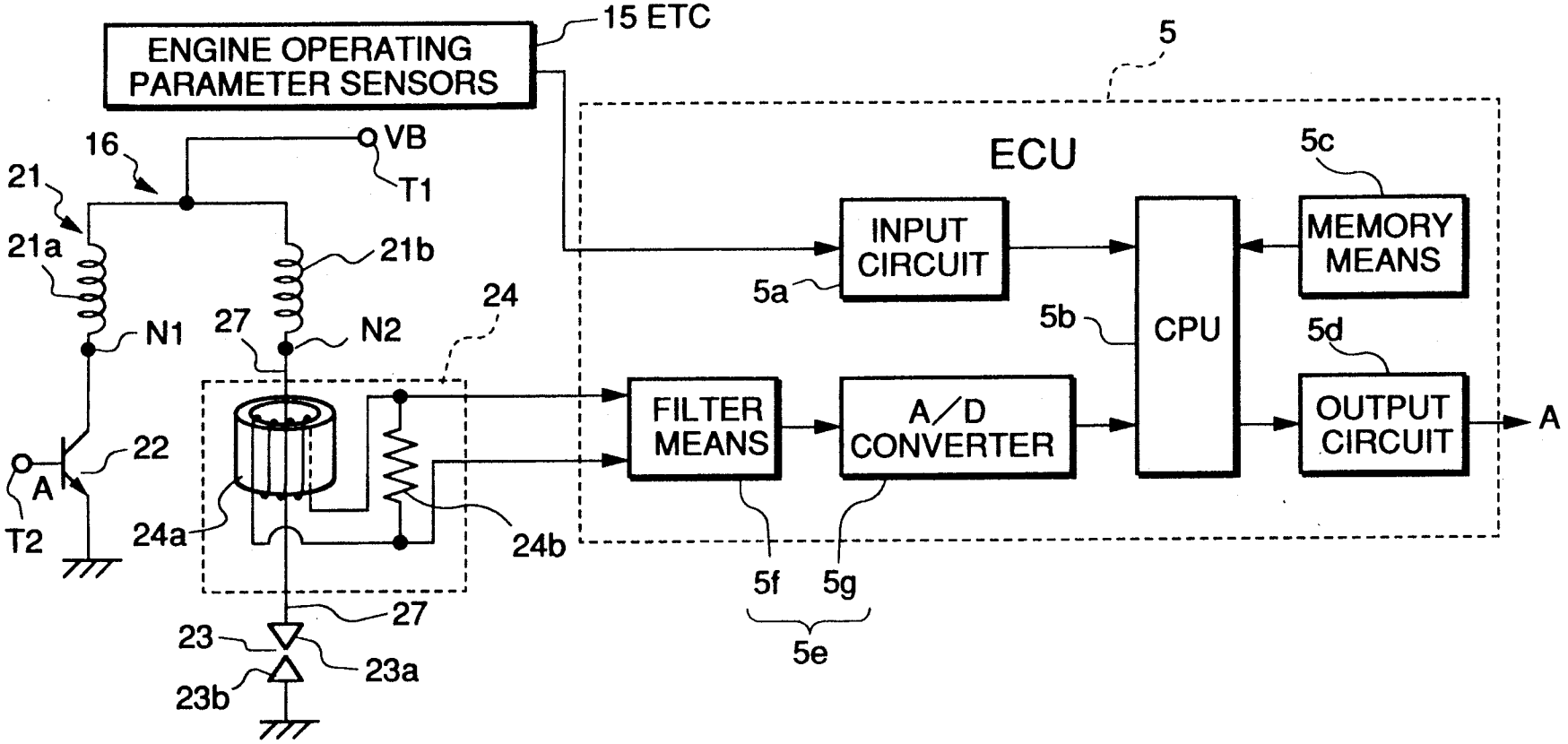
FIG. 2 is a block diagram showing the arrangement of the misfire-detecting system according to the invention.

FIG. 2 shows the arrangement of the misfire-detecting system according to the invention.

In FIG. 2, the ignition device 16 is constructed such that a feeding terminal T1, which is supplied with supply voltage VB, is connected to an ignition coil (igniting means) 21 comprised of a primary coil 21a and a secondary coil 21b. The primary and secondary coils 21a, 21b are connected with each other at one ends thereof. The other end of the primary coil 21a is connected to a collector of a transistor 22. The transistor 22 has its base connected to an input terminal T2 which is supplied with the ignition command signal A and its emitter is grounded. The other end of the secondary coil 21b is connected to a center electrode 23a of a spark plug 23 of each engine cylinder by way of a high-voltage connection line 27 and current-detecting means 24. The spark plug 23 has its ground electrode 23b grounded. The current-detecting means 24 has a coil 24a through which current flows in an amount corresponding to an amount of current flowing through the secondary coil 21b. The coil 24a is connected to a voltage-generating resistance 24b which generates a voltage corresponding to the amount of current flowing through the coil 24a. The output of the current-detecting means 24 is connected to the CPU 5b by way of filter means 5f and an A/D converter 5g which cooperate to form the misfire-detecting circuit 5e. Further connected via the input circuit 5a to the CPU 5b are engine operating parameter sensors including the engine rotational speed sensor 15, which sense various engine operating parameters such as engine rotational speed and engine load. The base of the transistor 22 is connected to the output circuit 5d of the ECU 5 to be supplied with a driving signal, i.e. amplified ignition command signal A therefrom. The CPU 5b forms signal-generating means responsive to the sensed engine operating parameters for determining the ignition timing and generating the corresponding ignition command signal A, and misfire-determining means for determining whether a misfire has occurred in the engine.

Figure 3:
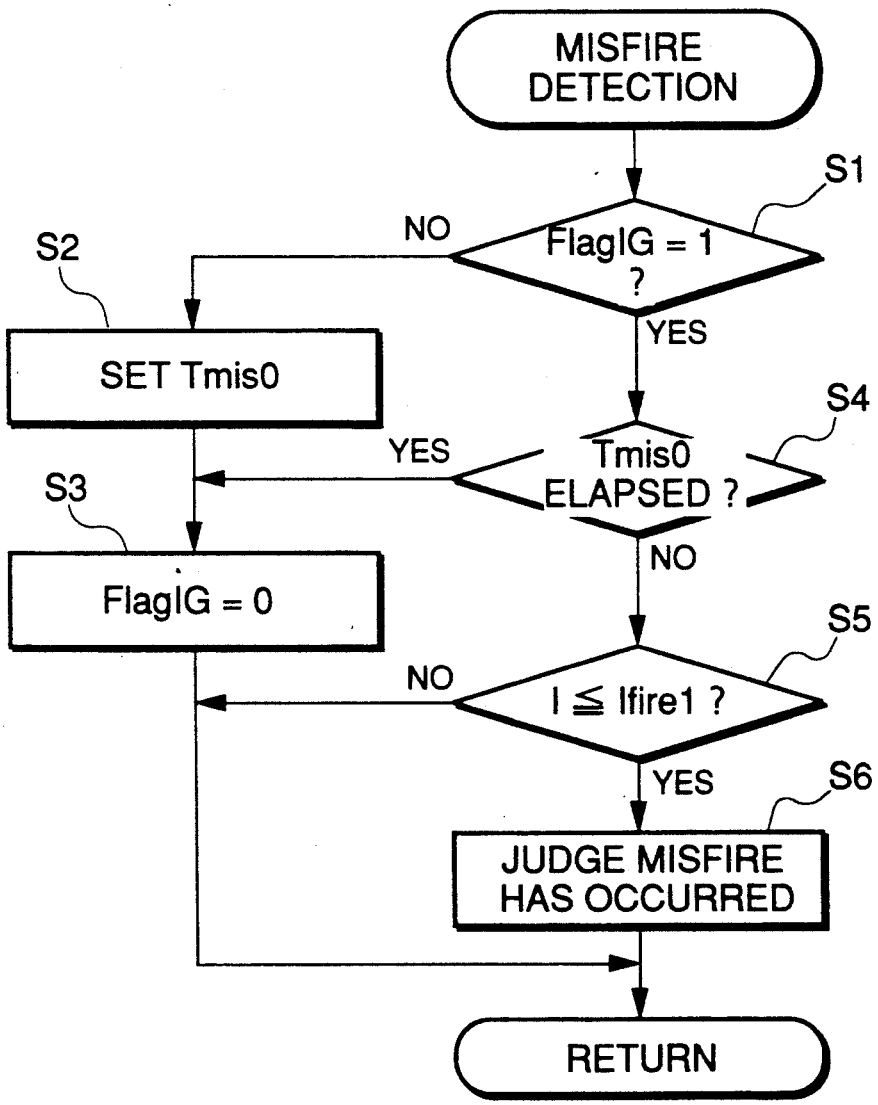
FIG. 3 is a flowchart showing a manner of detecting a misfire occurring in the engine according to a first embodiment of the invention.

FIG. 3 shows a manner of detecting a misfire by the use of the circuit of FIG. 2, according to a first embodiment of the invention.

Figure 4:
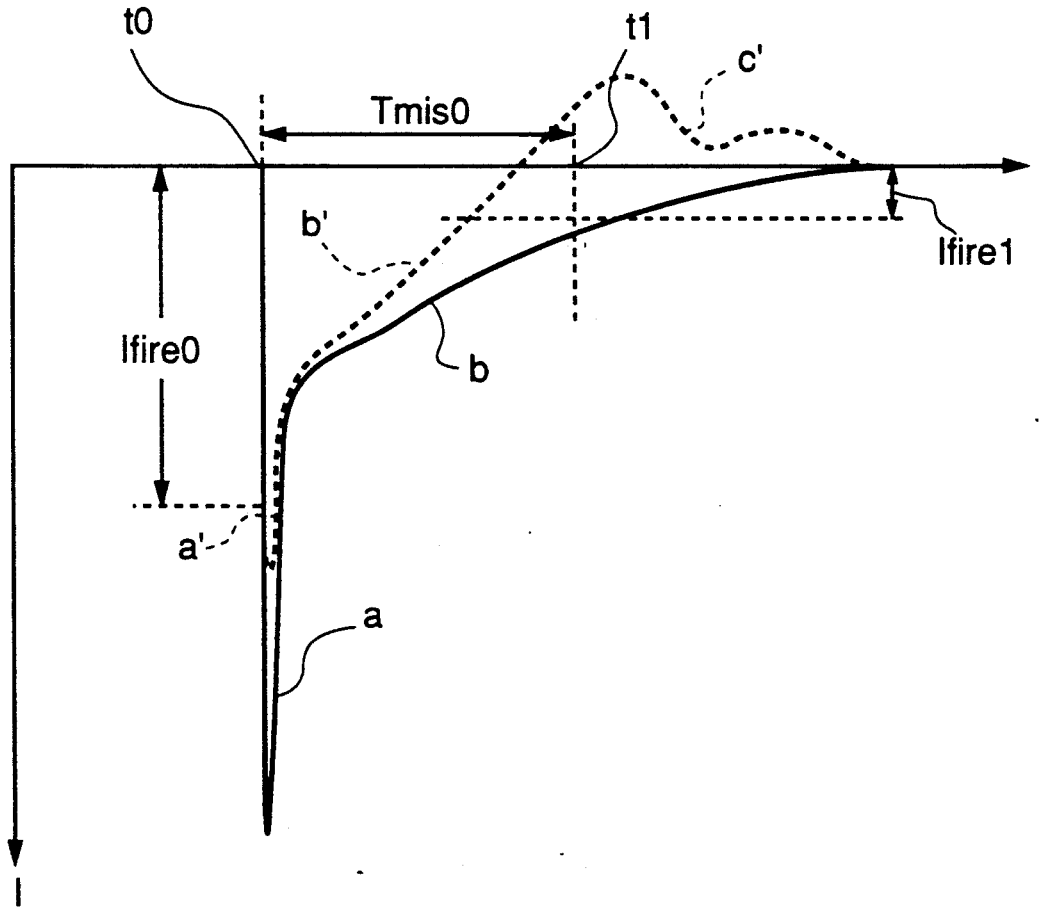
FIG. 4 is a timing chart showing changes in the discharge current, useful in explaining the manner of detecting a misfire according to the first embodiment.

FIG. 4 is a timing chart showing changes in discharge current generated by the secondary coil 21b of the ignition coil 21, which flows between the electrodes 23a, 23b of the spark plug 23, the discharge current being generated in response to the ignition command signal A.

In FIG. 4, the solid line indicates discharge current obtained when the mixture is normally fired, and the broken line discharge current obtained when a misfire occurs.

Discharge current characteristics obtainable in the above respective cases will now be explained with reference to FIG. 4.

First, a discharge current characteristic obtainable in the case of normal firing will be explained, which is indicated by the solid line. Immediately after a time point t0 to the ignition command signal A is generated, sparking voltage rises to such a level as to cause dielectric breakdown of the mixture between the electrodes of the spark plug, i.e. across the discharging gap of the spark plug. The dielectric breakdown causes a flow of current (curve a) between the spark plug electrodes. This current is rush current at the beginning of the dielectric breakdown, which is large in amount (several hundreds amperes). For example, as shown in FIG. 4, when the discharge current I has exceeded a reference current value Ifire0 for determination of a normal firing, i.e. $I > Ifire0$, dielectric breakdown of the mixture occurs, and then the discharge state shifts from a capacitive discharge state before the dielectric breakdown (early-stage capacitive discharge), to an inductive discharge state where inductive energy stored in the ignition coil through which discharge current I flows is released (curve b). With the release of inductive energy, the discharge current is lowered toward zero.

Next, reference is made to a discharge current characteristic indicated by the broken line in FIG. 4, which is obtained when an FI misfire occurs, which is caused by the supply of a lean mixture to the engine or cutting-off of the fuel supply to the engine due to failure of the fuel supply system, etc. Immediately after the time point t0 of generation of the ignition command signal A, the sparking voltage rises above a level causing dielectric breakdown of the mixture between the electrodes of the spark plug, like the case of a normal firing. The dielectric breakdown causes a flow of current, which is rush current at the beginning of the dielectric breakdown which is large in amount. However, in this case, the ratio of air in the mixture is greater than when the mixture has an air-fuel ratio close to a stoichimetric ratio, and accordingly the dielectric strength of the mixture is high. Consequently, the discharge current (capacitive discharge current) becomes lower than that obtained in the case of normal firing of the mixture (curve a'), as shown in FIG. 4. Thereafter, the discharge state shifts to an inductive discharge state, as in the case of normal firing. However, in the early-stage capacitive discharge, a greater amount of energy was consumed than at normal firing and also the electrical resistance of the discharging gap of the plug at the discharge of the ignition coil is greater in the case of supply of a lean mixture, etc. than that in the case of normal firing so that the inductive discharge voltage rises to a higher level than at normal firing, resulting in a shortened inductive discharge period and hence an earlier shifting from the inductive discharge state to a late-stage capacitive discharge which occurs due to residual energy in the coil (curve b'). The capacitive discharge current upon the transition to the late-stage capacitive discharge state flows in the reverse direction and then declines to zero (curve c'), because, after the inductive discharge, charged stored in floating capacity of the high-voltage connection line 27, etc. is released by residual energy of the coil to cause a flow of current in the reverse direction. The residual energy then diminishes to zero.

Next, the operation of the misfire-detecting system of FIG. 2 according to the first embodiment of the invention will be explained with reference to FIGS. 3 and 4. The first embodiment is based upon the fact that when a misfire attributable to the fuel supply system (hereinafter referred to as "FI misfire") occurs, the value of discharge current generated at the spark plug reaches to zero (0 ampere) more quickly than at normal firing. This program is executed at predetermined fixed time intervals.

In FIG. 3, first, it is determined at a step S1 whether or not a flag IG, which is indicative of whether or not the ignition command signal A has been generated, has been set to a value of 1. The flag IG indicates, when set to 1, that the signal A has been generated. The flag IG is thus set to 1 upon generation of the signal, by a routine other than the FIG. 3 routine, e.g. an ignition timing-calculating routine. When the ignition command signal A has not been generated, the answer to the question of the step S1 is negative (No), and then the program proceeds to steps S2, and S3, where a timer within the ECU 5, which measures time elapsed after generation of the ignition command signal A, is set to a predetermined time period Tmis0 and the flag IG is set to 0, followed by terminating the program. The predetermined time period Tmis0 is set at a time period from the time of generation of the ignition command signal A to a time immediately before the value of discharge current indicated by the solid line falls below a reference current value Ifire1 for determination of an FI misfire (from time point t0 to time point t1 in FIG. 4), assumed when a normal firing occurs. The values Tmis0, Ifire1 are each read from a map or a table in accordance with operating conditions of the engine 1, e.g. engine rotational speed, engine load, battery voltage, and engine temperature.

When the ignition command signal A has been generated and hence the flag IG has been set to 1, the program proceeds from the step S1 to a step S4 to determine whether or not the predetermined time period Tmis0 has elapsed, from the count of the timer within the ECU 5. If the predetermined time period Tmis0 has not yet elapsed, it is determined at a step S5 whether or not the value of discharge current I is equal to or smaller than the reference current value IfireI ($I \leqq Ifire1$). If $I \leqq Ifire1$ holds, it is determined at a step S6 that an FI misfire has occurred, whereas if $I > Ifire1$ holds, the program is immediately terminated. The above operation is repeatedly executed until the predetermined time period Tmis0 elapses (until the time point t1 in FIG. 4 is reached). When the predetermined time period Tmis0 has elapsed, the flag IG is set to 0, followed by terminating the program. This is because, once the predetermined time period Tmis0 has elapsed, there is no possibility that an FI misfire is determined to have occurred.

As will be understood from the above description, according to the first embodiment of the invention, if a time period, over which the detected value of discharge current is above a predetermined current value (Ifire1) after generation of an ignition command signal, is shorter than a predetermined time period (Tmis0), it is determined that a misfire has occurred in the engine. As a specific example, according to the misfire-detecting manner of FIG. 3 described above, when the value I of discharge current decreases below the predetermined current value Ifire1 before the lapse of the predetermined time period Tmis0 after generation of the ignition command signal A, it is determined that an FI misfire has occurred. It is thus possible to accurately detect the occurrence of an FI misfire, to thereby locate the faulty place at an early time and take an appropriate fail-safe action.

Figure 5:
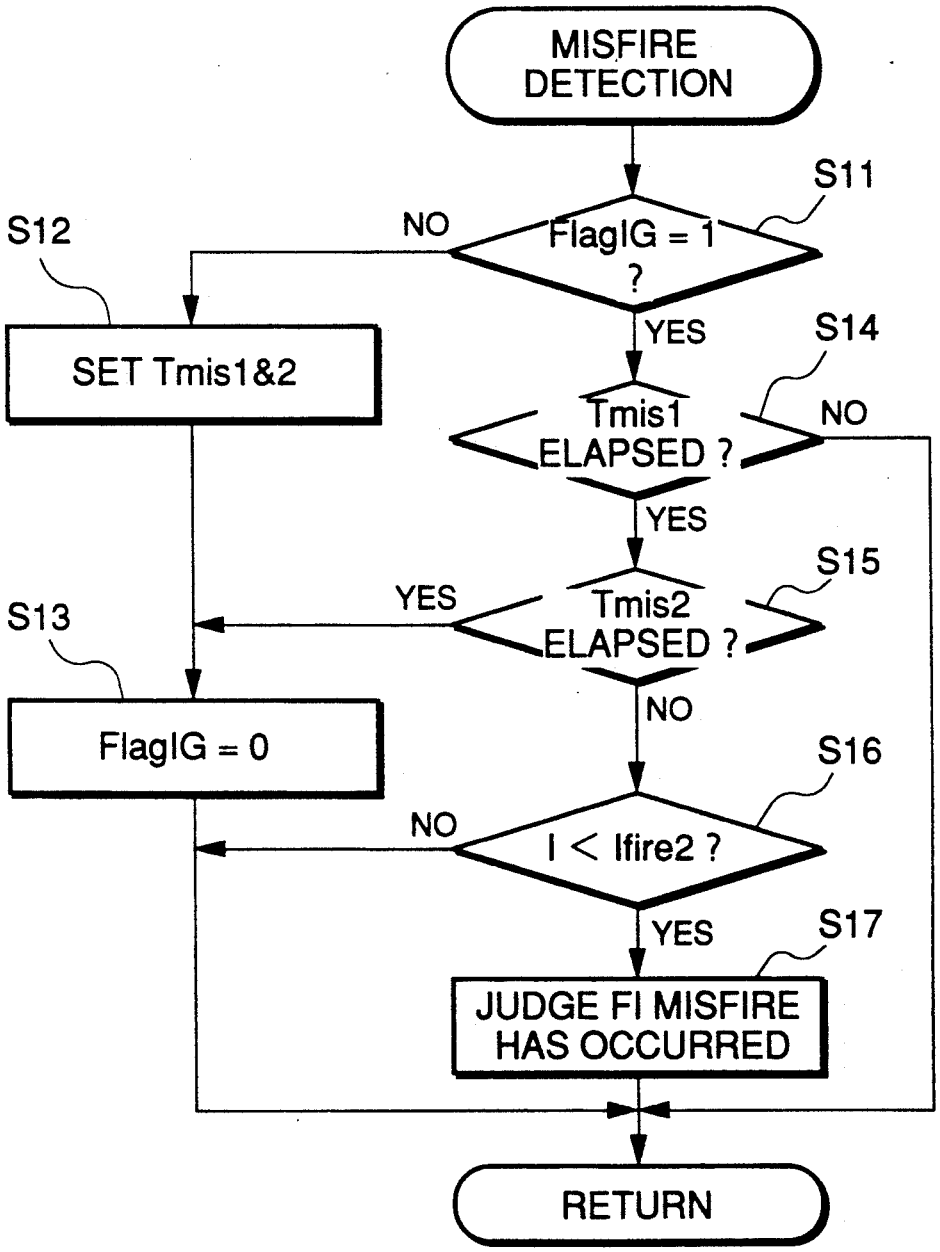
FIG. 5 is a flowchart showing a manner of detecting a misfire occurring in the engine according to a second embodiment of the invention.
Figure 6:
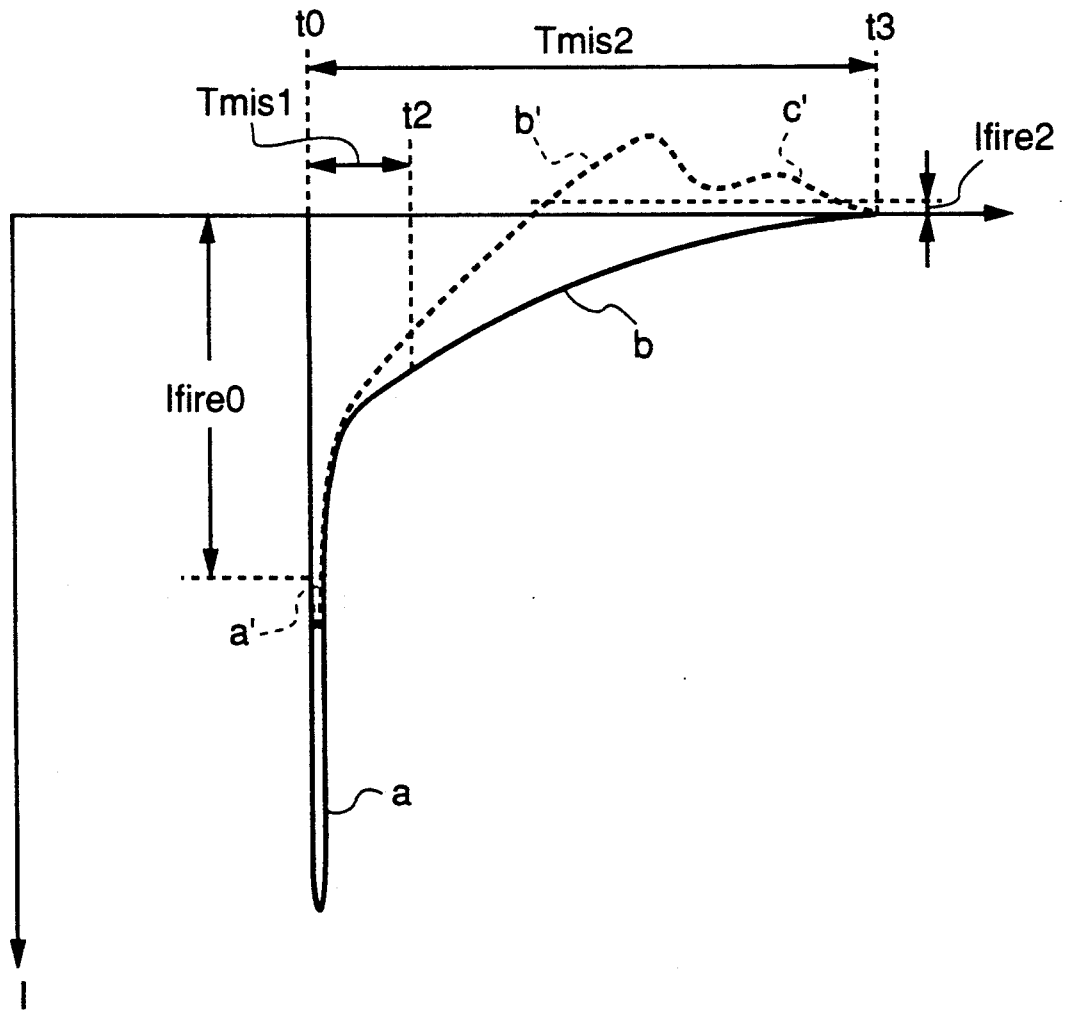
FIG. 6 is a timing chart showing changes in the discharge current useful in explaining the manner of detecting a misfire according to the second embodiment.

Next, reference is made to FIGS. 5 and 6 showing a manner of detecting an FI misfire according to a second embodiment of the invention, which detects an FI misfire by means of the misfire-detecting system according to the invention, shown in FIG. 2.

In FIG. 6, the solid line shows a change in the discharge current at normal firing, and the broken line a change in the discharge current at misfire.

The second embodiment is based upon the fact that when an FI misfire occurs, the discharge current generated at the spark plug shows a negative value which cannot be assumed at normal firing.

In FIG. 5, it is determined at a step S11 whether or not the flag IG also used in the program of FIG. 3 is equal to 1. When the ignition command signal A has not been generated, the flag IG has not been set to 1, and accordingly the program proceeds from the step S11 to steps S12 and S13 to set timers within the ECU 5 (timers which measure time elapsed after generation of the ignition command signal A, are set to first and second predetermined time periods Tmis1, Tmis2, respectively) and set the flag IG to 0, followed by terminating the program. The predetermined time periods Tmis1, Tmis2 both start from a time point t0 in FIG. 6 at which the ignition command signal A is generated, and end, respectively, at time points t2 and t3. The values Tmis1, Tmis2 as well as a reference current value Ifire2 for determination of FI misfire, hereinafter referred to, are each read from a map or a table in accordance with operating conditions of the engine 1, e.g. engine rotational speed, engine load, battery voltage, and engine temperature.

When the ignition command signal A has been generated and hence the flag IG has been set to 1, the program proceeds from the step S11 to a step S14 to determine whether or not the first predetermined time period Tmis1 has elapsed, from the count of the corresponding timer within the ECU 5. If the first predetermined time period Tmis1 has not yet elapsed, the present program is immediately terminated. If the first predetermined time period Tmis1 has elapsed, it is determined at a step S15 whether or not the second predetermined time period Tmis2 has elapsed, from the count of the corresponding timer within the ECU 5. When the predetermined time period Tmis2 has elapsed, the flag IG is set to 0, followed by terminating the program, because, once the predetermined time period Tmis2 has elapsed, there is no possibility that an FI misfire is determined to have occurred. If the predetermined time period Tmis2 has not yet elapsed, it is determined at a step S16 whether or not the value of discharge current I is smaller than the reference current value Ifire2 which is a negative value, as shown in FIG. 6. If $I < Ifire1$ holds, it is determined at a step S17 that an FI misfire has occurred (see the characteristic curve shown by the broken line in FIG. 6), followed by terminating the program, whereas if $I \geqq Ifire2$ holds, it is presumed that an FI misfire has not occurred, and then the program is immediately terminated. The present program is repeatedly executed until the predetermined time period Tmis2 elapses (until the time point t3 in FIG. 6 is reached).

Although in the second embodiment described above, the reference current value Ifire2 is set to a negative value, it may be set to a value of zero (0 ampere) or a value slightly greater than zero, and at the same time the predetermined time period Tmis2 may be set to a slightly shorter value so as to avoid a misjudgement that an FI misfire has occurred even in the case of a normal firing.

As described above, according the second embodiment of the invention, if a time period over which the detected value of discharge current is above a predetermined value, after the lapse of a first predetermined time period from the time of generation of an ignition command signal is shorter than a second predetermined time period, it is determined that a misfire has occurred in the engine. As a specific example, according to the misfire-detecting manner of FIG. 5 described above, when the detected value I of discharge current drops below the predetermined current value Ifire2 before the lapse of the second predetermined time period Tmis2 after the lapse of the first predetermined time period Tmis1 from the time of generation of the ignition command signal A, it is determined that an FI misfire has occurred. It is thus possible to accurately detect the occurrence of an FI misfire, to thereby locate the faulty place at an early time and take an appropriate fail-safe action.

Figure 7:
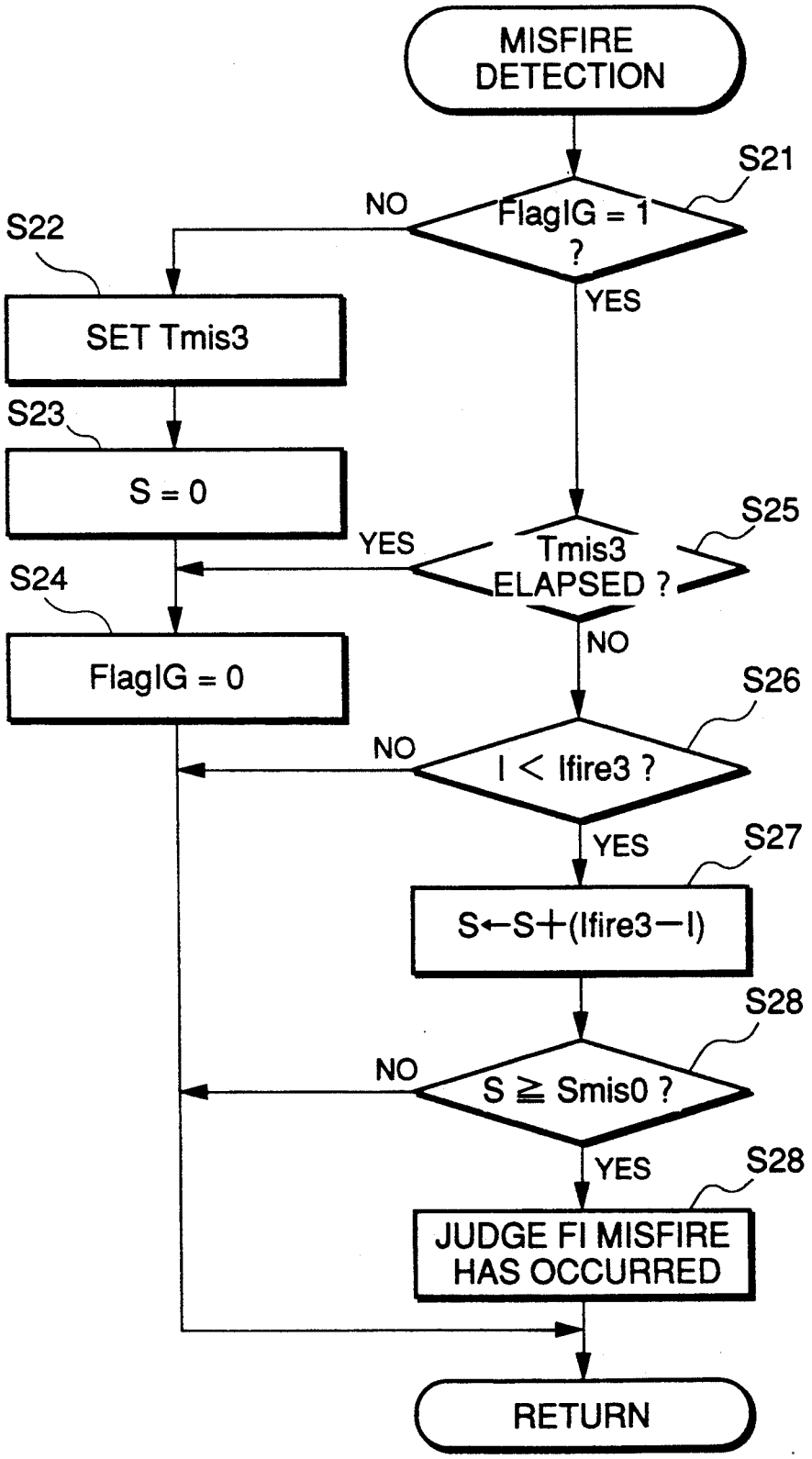
FIG. 7 is a flowchart showing a manner of detecting a misfire occurring in the engine according to a third embodiment of the invention.
Figure 8:
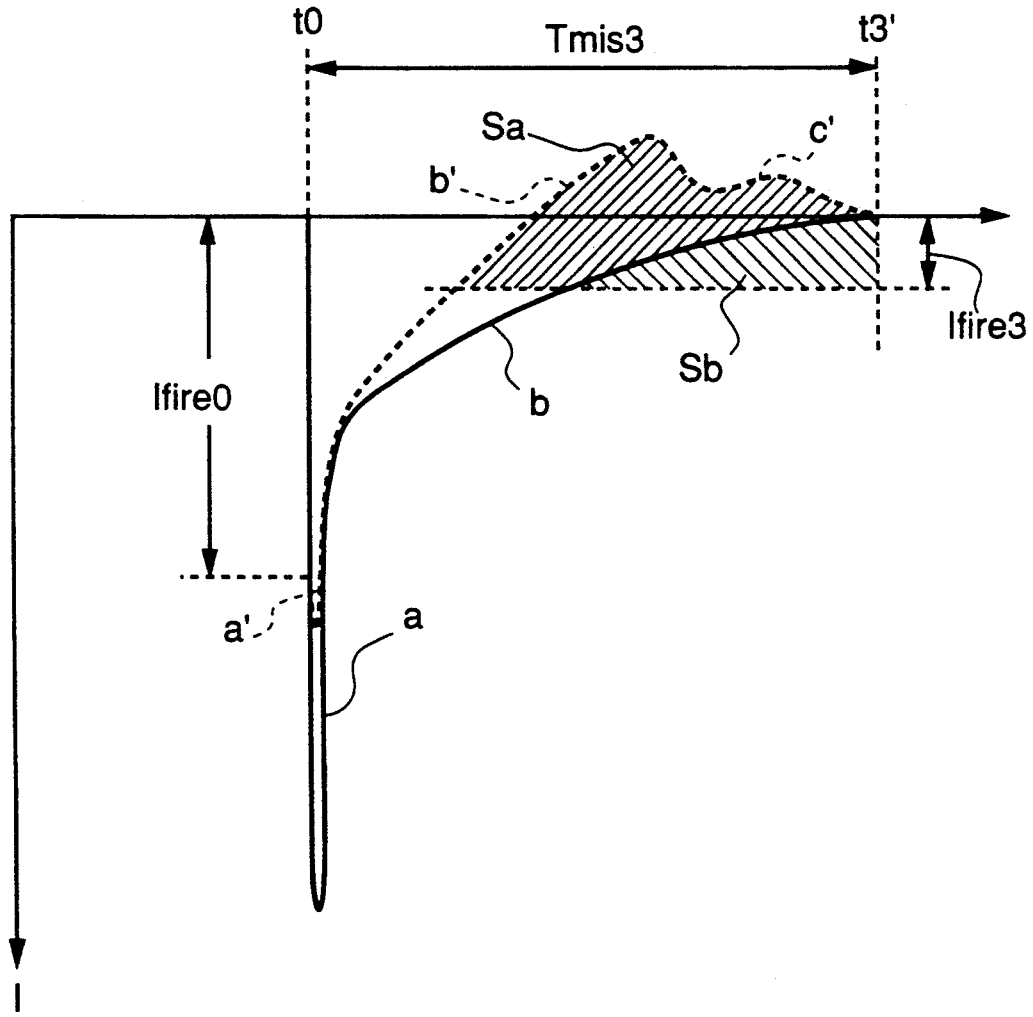
FIG. 8 is a timing chart showing changes in the discharge current, useful in explaining the manner of detecting misfire according to the third embodiment.

FIG. 7 shows a manner of carrying out the misfire-detecting operation of the system of FIG. 2 according to a third embodiment of the invention. FIG. 8 is a timing chart similar to FIG. 4, for explaining the misfire-detecting operation according to the third embodiment, wherein like FIG. 4, the solid line shows a change in the discharge current at normal firing, and the broken line a change in the discharge current at misfire.

The third embodiment is based upon the fact that when an FI misfire occurs, the value of discharge current generated at the spark plug drops to zero (0 ampere) earlier than when a normal firing has occurred, and then further drops to a negative value. According to the program of FIG. 7, misfire-detection is carried out based upon a value proportional to an area of a portion of values of discharge current being lower than a predetermined current value.

In FIG. 7, it is first determined at a step S21 whether or not the flag IG is equal to 1. When the ignition command signal A has not been generated, the flag IG is not equal to 0, and accordingly the program proceeds from the step S21 to step S22–S24, where a timer within the ECU 5 which measures time elapsed after generation of the ignition command signal A is set to a predetermined time period Tmis3, a value proportional to an area S is initialized to zero and the initialized value is stored into the memory means 5c of the ECU 5, and the flag IG is set to 0, followed by terminating the program. The predetermined time period Tmis3 is a time period similar to the predetermined time period Tmis2 applied in the second embodiment described hereinbefore, i.e. it starts from the time of generation of the ignition command signal H (time point t0 in FIG. 8) and terminates when the discharge current value becomes nearly zero (0 ampere) (time point t3′ in FIG. 8). The value Tmis3 is read from a map or a table in accordance with operating parameter values of the engine, such as engine rotational speed, engine load, battery voltage, and engine temperature.

When the ignition command signal A has been generated and hence the flag IG has been set to 1, the program proceeds from the step S21 to a step S25 to determine whether or not the predetermined time period Tmis3 has elapsed, from the count of the timer within the ECU 5. If the predetermined time period Tmis3 has elapsed, the flag IG is set to 0 at a step S24, followed by terminating the program. When the predetermined time period Tmis3 has not yet elapsed, it is determined at a step S26 whether or not the value of discharge current I is smaller than the reference current value Ifire3 ($I<Ifire3$). If $I \geqq Ifire3$ holds, the program is immediately terminated. If $I<Ifire3$ holds, the program proceeds to a step S27, hereinafter referred to. The value Ifire3 is read from a map or a table in accordance with operating parameter values of the engine, such as engine rotational speed, engine load, battery voltage, and engine temperature. The value Ifire3 is set such that the difference (Sa−Sb) between the value proportional to an area Sa defined by a line indicative of the value Ifire3 and a portion of a curve indicative of the discharge current 1 at misfire indicated by the broken line in FIG. 8 below the value Ifire3 (the portion hatched by leftwardly falling lines in FIG. 8) and the value proportional to an area Sb defined by the above line and a portion of a curve indicative of the discharge current I at normal firing indicated by the solid line in FIG. 8 below the value Ifire3 (the portion hatched by rightwardly falling lines in FIG. 8) is large enough to make a positive misfire judgement.

Next, at the step S27, a difference (Ifire3−I) between the detected discharge current value I and the predetermined current value Ifire3, and the calculated value is added to the value S initialized to zero or calculated in the last loop and stored to obtain a new value proportional to the area S. The new value proportional to the area S is compared with a predetermined value Smis0 at a step S28. If $S \geqq Smis0$ holds, it is determined at a step S29 that an FI misfire has occurred. The above steps S21, and S25–S29 are repeatedly executed until the predetermined time period Tmis3 elapses (i.e. until the time point t3′ in FIG. 8 is reached). When the predetermined time period Tmis3 has elapsed, the flag IG is set to 0 at the step S24, followed by terminating the program.

Even by the third embodiment described above, it is possible to accurately detect an FI misfire, and hence locate the faulty place and take an appropriate fail-safe action.

Figure 9:
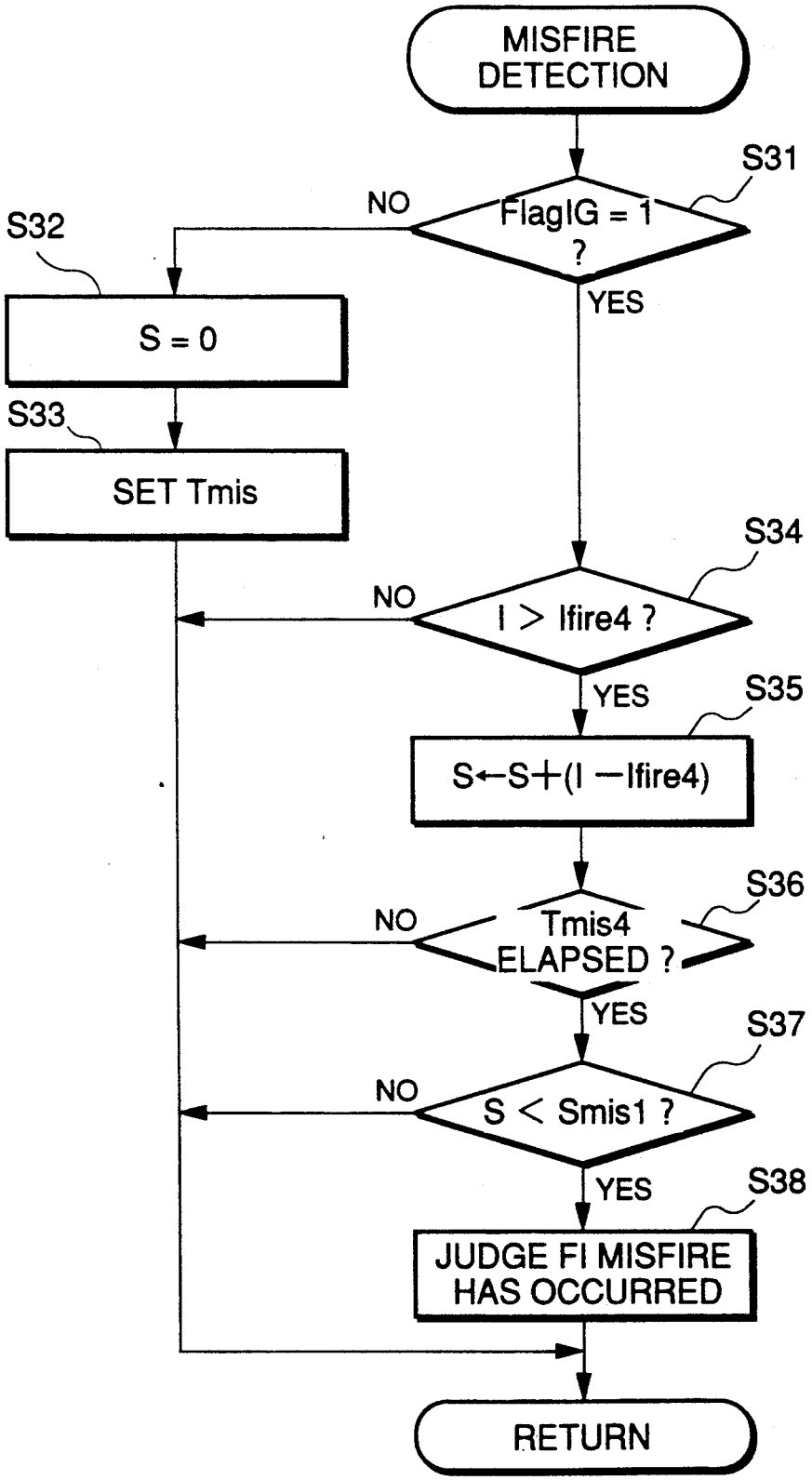
FIG. 9 is a flowchart showing a manner of detecting a misfire occurring in the engine according to a fourth embodiment of the invention.
Figure 10:
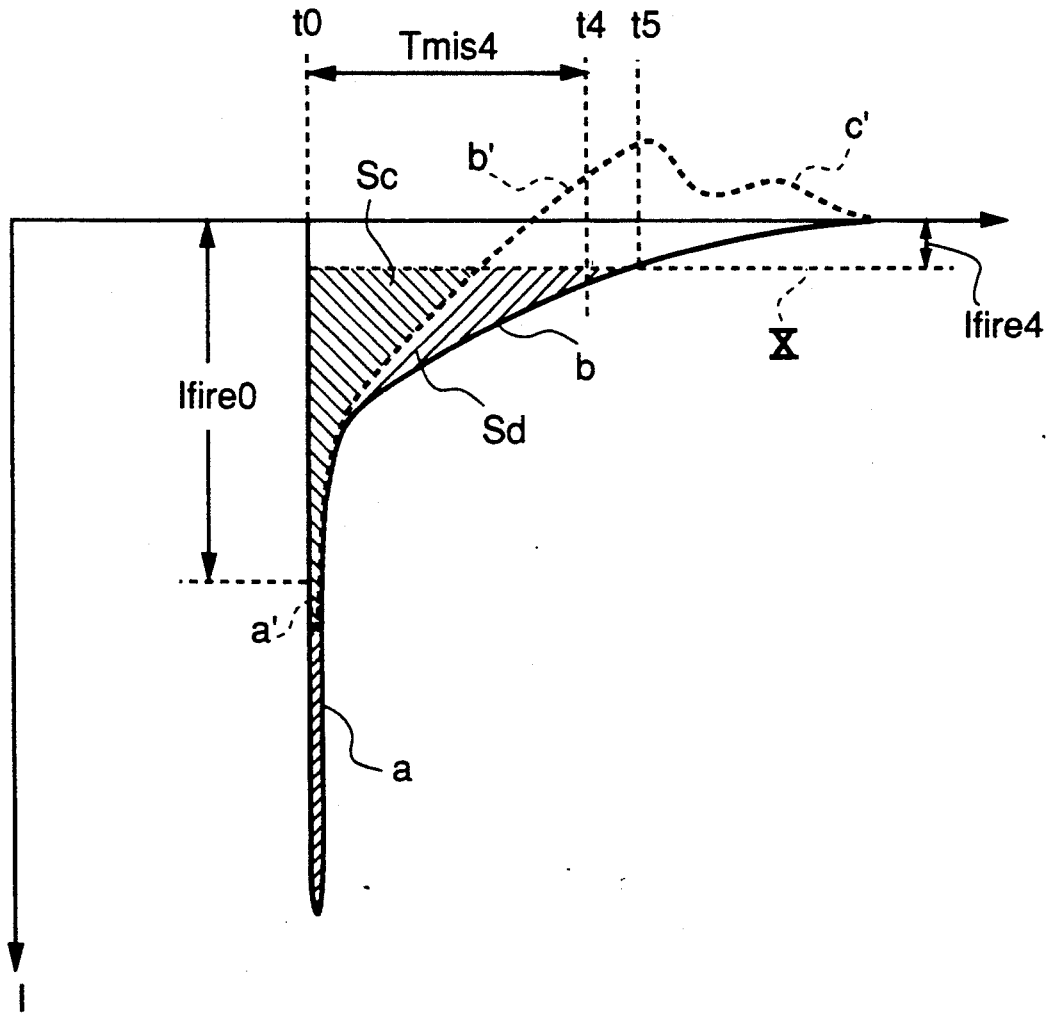
FIG. 10 is a timing chart showing changes in the discharge current, useful in explaining the manner of detecting a misfire according to the fourth embodiment.

FIG. 9 shows a manner of carrying out the misfire-detecting operation of the system of FIG. 2 according to a fourth embodiment of the invention. FIG. 10 is a timing chart similar to FIG. 4, for explaining the operation according to the fourth embodiment, wherein like FIG. 4, the solid line shows a change in the discharge current at normal firing, and the broken line a change in the discharge current at misfire.

In FIG. 10, a value proportional to an area Sc defined by a line X indicative of a reference current value Ifire4 for determination of an FI misfire and a curve indicative of discharge current generated at FI misfire is larger than a value proportional to an area Sd defined by the above line X and a curve indicative of discharge current generated at normal firing. The fourth embodiment utilizes this fact.

In FIG. 9, first, it is determined at a step S31 whether or not the flag IG is equal to 1. When the ignition command signal A has not been generated and accordingly the flag IG has not been set to 1, the program proceeds from the step S31 to steps S32 and S33, where a timer within the ECU 5 which measures time elapsed after generation of the ignition command signal A is set to a predetermined time period Tmis4, a value proportional to an area value S is initialized to zero, and the initialized value S is stored into the memory means 5c, followed by terminating the program.

When the ignition command signal A has been generated and hence the flag IG has been set to 1, the program proceeds from the step S31 to a step S34 to determine whether or not the value of discharge current I exceeds a reference current value Ifire4. If the former does not exceed the latter, i.e. if $I \leqq Ifire4$ holds, the program is terminated, whereas if the former exceeds the latter, i.e. if $I > Ifirer4$ holds, the difference ($I - Ifire4$) between the discharge current value I and the reference current value Ifire4 is calculated, and a value obtained from the calculated difference is added to the value S initialized to zero or obtained in the last loop and stored, at a step S35.

Then, it is determined at a step S36 whether or not the predetermined time period Tmis4 has elapsed, from the count of the timer within the ECU 5. If the predetermined time period Tmis4 has elapsed, the program is immediately terminated, whereas if it has not elapsed, the program proceeds to a step S37. In FIG. 10, the predetermined time period Tmis4 starts from a time point t0 at which the ignition command signal A is generated and terminates at a time point t4 which is set close to or immediately before a time point t5 at which discharge current I becomes equal to the reference current value Ifire4 at normal firing, as indicated by the solid line in FIG. 10.

Then, it is determined at a step S37 whether or not the value S obtained at the step S35 is smaller than a predetermined value Smis1. If $S \geqq Smis1$ holds, the program is immediately terminated, determining that no FI misfire has occurred, while if $S < Smis1$ holds, it is determined at a step S38 that an FI misfire has occurred. The above steps S31 and S34–S38 are repeatedly executed until the predetermined time period Tmis4 elapses (step S36).

The values Tmis4, Ifire4, and Smis1 are each read from a map or a table in accordance with operating parameter values of the engine, such as engine rotational speed, engine load, battery voltage, and engine temperature.

Even by the fourth embodiment described above, it is possible to accurately detect an FI misfire, and hence locate the faulty place and take an appropriate fail-safe action.

What is claimed is:

1. A misfire-detecting system for detecting a misfire occurring in an internal combustion engine having an ignition system including at least one spark plug, engine operating condition-detecting means for detecting values of operating parameters of said engine, signal-generating means for determining ignition timing of said engine, based upon the detected values of said operating parameters of said engine and for generating an ignition command signal indicative of the determined ignition timing, and igniting means responsive to said ignition command signal for generating sparking voltage for discharging said at least one spark plug, said misfire-detecting system comprising:

current value-detecting means for detecting a value of discharge current when said sparking voltage is generated by said igniting means in response to generation of said ignition command signal; and misfire-determining means for comparing the detected value of said discharge current with a predetermined current value, said predetermined current value set in response to the detected values of said operating parameters of said engine from said engine operating condition-detecting means, and for determining whether or not a misfire has occurred in said engine, based upon results of said comparison;

said misfire-determining means for determining that a misfire has occurred when a time period, in which the detected value of said discharge current is above said predetermined current value after generation of said ignition command signal, is shorter than a predetermined time period, said predetermined time period set in response to the detected values of said operating parameters of said engine from said engine operating condition-detecting means.

2. A misfire-detecting system for detecting a misfire occurring in an internal combustion engine having an ignition system including at least one spark plug, engine operating condition-detecting means for detecting values of operating parameters of said engine, signal-generating means for determining ignition timing of said engine, based upon the detected values of said operating parameters of said engine and for generating an ignition command signal indicative of the determined ignition timing, and igniting means responsive to said ignition command signal for generating sparking voltage for discharging said at least one spark plug, said misfire-detecting system comprising:

current value-detecting means for detecting a value of discharge current when said sparking voltage is generated by said igniting means in response to generation of said ignition command signal; and misfire-determining means for comparing the detected value of said discharge current with a predetermined current value, said predetermined current value set in response to the detected values of said operating parameters of said engine from said engine operating condition-detecting means, and for determining whether or not a misfire has occurred in said engine, based upon results of said comparison;

said misfire-determining means for determining that a misfire has occurred when a time period, from a time at which said ignition command signal is generated to a time at which the detected value of said discharge current decreases below said predetermined current value, is shorter than a predetermined time period.

3. A misfire-detecting system for detecting a misfire occurring in an internal combustion engine having an ignition system including at least one spark plug, engine operating condition-detecting means for detecting values of operating parameters of said engine, signal-generating means for determining ignition timing of said engine, based upon the detected values of said operating parameters of said engine and for generating an ignition command signal indicative of the determined ignition timing, and igniting means responsive to said ignition command signal for generating sparking voltage for discharging said at least one spark plug;

said misfire-detecting system comprising:

current value-detecting means for detecting a value of discharge current when said sparking voltage is generated by said igniting means in response to generation of said ignition command signal; and misfire-determining means for comparing the detected value of said discharge current with a predetermined current value, said predetermined current value set in response to the detected values of said operating parameters of said engine from said engine operating condition-detecting means and for determining whether or not a misfire has occurred in said engine, based upon results of said comparison;

said misfire-determining means for determining that a misfire has occurred when a time period, in which the detected value of said discharge current is above said predetermined current value after a lapse of a first predetermined time period from the time of generation of said ignition command signal, is shorter than a second predetermined time period wherein said first and second predetermined time periods are set in response to the detected values of said operating parameters of said engine from said engine operating condition-detecting means.

4. A misfire-detecting system for detecting a misfire occurring in an internal combustion engine having an ignition system including at least one spark plug, engine operating condition-detecting means for detecting values of operating parameters of said engine, signal-generating means for determining ignition timing of said engine, based upon the detected values of said operating parameters of said engine and for generating an ignition command signal indicative of the determined ignition timing, and igniting means responsive to said ignition command signal for generating sparking voltage for discharging said at least one spark plug;

said misfire-detecting system comprising:

current value-detecting means for detecting a value of discharge current when said sparking voltage is generated by said igniting means in response to generation of said ignition command signal; and misfire-determining means for comparing the detected value of said discharge current with a predetermined current value, said predetermined current value set in response to the detected values of said operating parameters of said engine from said engine operating condition-detecting means and for determining whether or not a misfire has occurred in said engine, based upon results of said comparison;

said misfire-determining means for determining that a misfire has occurred when a time period, from a time at which a first predetermined time period has elapsed after generation of said ignition command signal to a time at which the detected value of said discharge current decreases below said predetermined current value, is shorter than a second predetermined time period.

5. A misfire-detecting system for detecting a misfire occurring in an internal combustion engine having an ignition system including at least one spark plug, engine operating condition-detecting means for detecting values of operating parameters of said engine, signal-generating means for determining ignition timing of said engine, based upon the detected values of said operating parameters of said engine and for generating an ignition command signal indicative of the determined ignition timing, and igniting means responsive to said ignition command signal for generating sparking voltage for discharging said at least one spark plug, said misfire-detecting system comprising:

current value-detecting means for detecting a value of discharge current when said sparking voltage is generated by said igniting means in response to generation of said ignition command signal; and misfire-determining means for comparing the detected value of said discharge current with a predetermined current value, and for determining whether or not a misfire has occurred in said engine, based upon results of said comparison;

said misfire-determining means for determining a value proportional to an area of a portion of detected values of said discharge value below said predetermined current value before a predetermined time period elapses after generation of said ignition command signal, and for determining that a misfire has occurred, when the determined value proportional to said area is equal to or larger than a predetermined area value.

6. A misfire-detecting system for detecting a misfire occurring in an internal combustion engine having an ignition system including at least one spark plug, engine operating condition-detecting means for detecting values of operating parameters of said engine, signal-generating means for determining ignition timing of said engine, based upon the detected values of said operating parameters of said engine and for generating an ignition command signal indicative of the determined ignition timing, and igniting means responsive to said ignition command signal for generating sparking voltage for discharging said at least one spark plug, said misfire-detecting system comprising:

current value-detecting means for detecting a value of discharge current when said sparking value is generated by said igniting means in response to generation of said ignition command signal; and misfire-determining means for comparing the detected value of said discharge current with a predetermined current value, and for determining whether or not a misfire has occurred in said engine, based upon results of said comparison;

said misfire-determining means for determining a value proportional to an area of a portion of detected values of said discharge value above said predetermined current value before a predetermined time period elapses after generation of said ignition command signal, and for determining that a misfire has occurred, when the determined value proportional to said area is smaller than a predetermined area value.

* * * * *